US007171905B2

(12) United States Patent
Hirt et al.

(10) Patent No.: US 7,171,905 B2
(45) Date of Patent: Feb. 6, 2007

(54) HOLLOW POINT BULLETS AND METHODS OF FABRICATING THE SAME

(75) Inventors: Robert Hirt, Balingen-Stettberg (DE); Heinz Seeger, Schopfloch (DE); Marc Roth, Oberndorf (DE); Hans-Jürgen Kron, Vöhringen (DE)

(73) Assignee: Heckler & Koch, GmbH, Oberndorf/Neckar (DE)

( * ) Notice: Subject to any disclaimer, the term of this patent is extended or adjusted under 35 U.S.C. 154(b) by 0 days.

(21) Appl. No.: 11/292,977

(22) Filed: Dec. 2, 2005

(65) Prior Publication Data

US 2006/0144280 A1 Jul. 6, 2006

Related U.S. Application Data

(63) Continuation of application No. PCT/EP2004/006015, filed on Jun. 3, 2004.

(30) Foreign Application Priority Data

Jun. 5, 2003 (DE) ..... 103 25 547

(51) Int. Cl.
*F42B 12/00* (2006.01)

(52) U.S. Cl. ..... 102/509; 102/507; 102/508

(58) Field of Classification Search ..... 102/507–510
See application file for complete search history.

(56) References Cited

U.S. PATENT DOCUMENTS 3,011,442 A * 12/1961 Wenig ..... 102/249
5,127,332 A 7/1992 Corzine et al.
5,131,123 A 7/1992 Brooks
5,200,573 A * 4/1993 Blood ..... 102/501
5,259,320 A * 11/1993 Brooks ..... 102/509
6,971,315 B2 * 12/2005 Knappworst et al. ..... 102/510

FOREIGN PATENT DOCUMENTS

| | | |
|---|---|---|
| DE | 2228733 | 1/1973 |
| DE | 19930475 | 1/2001 |
| WO | 9307438 | 4/1993 |

OTHER PUBLICATIONS

German Language International Search Report for PCT/EP2004/006015, 2 pages.
English Translation of International Preliminary Report on Patentability for PCT/EP2004/006015, 2 pages.
Notification of Transmittal of Copies of Translation of the International Preliminary Report on Patentability for PCT/EP04/006015, May 11, 2006, 5 pages.

* cited by examiner

*Primary Examiner*—Michael J. Carone
*Assistant Examiner*—Gabriel J. Klein
(74) *Attorney, Agent, or Firm*—Hanley, Flight & Zimmerman, LLC

(57) ABSTRACT

A hollow point bullet and methods for fabricating the same are disclosed. An example hollow point bullet includes a recess opened at a tip of the bullet that includes a first portion and a second portion. The first portion opens to the tip of the bullet and has a square cross-section, and the second portion has a circular cross-section.

20 Claims, 1 Drawing Sheet

HOLLOW POINT BULLETS AND METHODS OF FABRICATING THE SAME

RELATED APPLICATION

This patent is a continuation of International Patent Application Ser. No. PCT/EP2004/006015, filed Jun. 3, 2004, which is hereby incorporated herein by reference in its entirety.

TECHNICAL FIELD

This disclosure relates generally to ammunition and, more particularly, to hollow point bullets and methods of fabricating the same.

BACKGROUND

Hollow point bullets have been used as ammunition for many years. Hollow point bullets combine the advantages of a small-caliber jacket bullet, such as extended trajectory, with that of a large-caliber bullet, such as a high release of kinetic energy into a target. There are a variety of conventional hollow point bullets. Patent application WO 93/07 438 A1 discloses a hollow point bullet having a bore hole with a continuous square cross-section that empties at the tip of the bullet. German patent DE 22 28 733 A1 also shows a hollow point bullet with a bore hole having a continuous square-edged cross-section. The bore hole of the bullet disclosed in DE 22 28 733 A1 is larger than the bore hole of WO 93/07 438 A1 and is filled with lead or plastic. U.S. Pat. No. 5,131,123 discloses a hollow point bullet that is cylindrical. A square-edged cross-section wedge is pressed into the tip and removed to shape the cross-section of the hollow portion. The tip is then pressed again, which creates a coaxial inner bore hole with a square cross-section that almost closes completely at the tip. Similarly, U.S. Pat. No. 5,259,320, which is a divisional of U.S. Pat. No. 5,131,123, more generally discloses an intermediate product that is created in the production of the hollow point bullet.

The hollow point bullet disclosed in German Patent 22 28 733 is a two-part bullet that is particularly useful in the sport of hunting. When this two-part bullet strikes an animal, the front part, which has a hollow tip, separates from the larger back part in the body of the animal. An advantage to this bullet design is that the back part of the bullet typically falls out of the animal, providing an opening through which the blood of the animal can leak. The dripping blood allows the wounded animal to be hunted by a dog more easily. However, a disadvantage with a bullet of this design is that the splinters from the front of the bullet lace large portions of the flesh and bones of the animal.

In the field of law enforcement, police usually use the largest caliber pistols available, such as large-caliber machine pistols, because the objectives of a police officer are different than those of a hunter. A police officer needs to use bullets that have sufficient stopping power without causing unnecessary damage to the body of a suspect or a criminal. Further, with respect to property, structural and surface damage should be low. For example, if a shot hits a wall, the bullet should not penetrate enough to cause damage in areas where the police officer cannot see. A bullet with a caliber that is too small may not transfer sufficient kinetic energy to stop the target. Further, a bullet with a caliber that is too large may cause an unnecessary amount of damage.

From a military point of view, the aforementioned machine pistols are of little value, because they have extremely poor ballistics. For example, it is difficult for a marksman to use a weapon with such ammunition when the striking distance between him and the target changes because as the distance changes, the marksman's hold point needs to be altered accordingly. Modern gun cartridges for military guns and the like have very small calibers (e.g., approximately 4.5 through 5.5 millimeters). These smaller cartridges have several advantages including that marksman does not have to alter his hold point when aiming in close range (e.g., less than approximately 200 meters) because the bullets are fast and light. The marksman also need not concern himself regarding his handling of the weapon when a target approaches or retreats a few meters.

The penetrating power of such modern small cartridges is, from a military point of view, sufficient. For example, these small cartridges would penetrate clear through a flak jacket, which usually protects from pistol bullets, when hit from a distance of 100 meters. However, after these bullets hit the human body, the bullets would continue to fly for several hundred meters. Consequently, very little kinetic energy is transferred to the body to the target. Therefore, a criminal, for example, who had not been killed, may be able to fight even after being shot.

DETAILED DESCRIPTION

Figure 1:
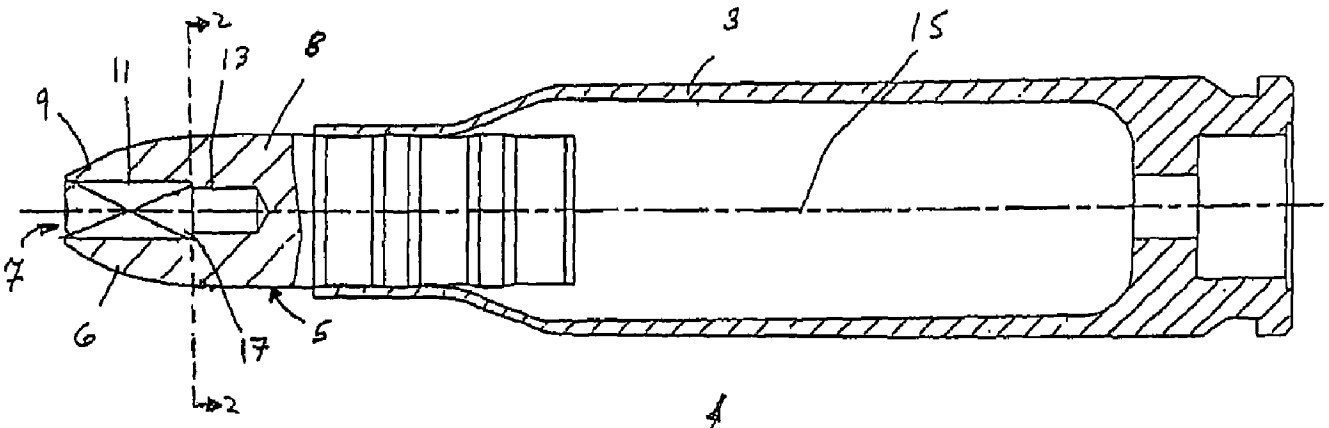
FIG. 1 shows a cross-sectional view of an example disclosed hollow point bullet.

Throughout this disclosure, the term "cylindrical" generally only means that all straight generatrices of a bore hole are parallel to each other. "Circular cylindrical" is a cylinder with a circular cross-section.

The drawings show a cartridge 1 with a shell 3 and a bullet 5, into which a coaxial recess 7 is formed, extending from the tip 9. The recess 7 includes a first portion 11 and a second portion 13. The first portion 11 may have a different shape and/or size than the second portion 13. In the illustrated example, the first portion has a square cross-section, which opens up into the tip 9 of the bullet 5. The square section 11 continues towards the second portion 13 having a round or circular cylindrical cross-section, which forms a tapped blind hole. The axes of the recesses 11 and 13 coincide with the same center axis 15 of bullet 5 and cartridge shell 3.

Figure 2:
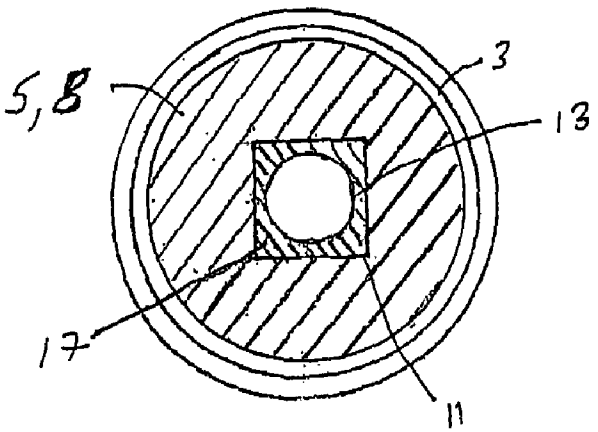
FIG. 2 is an enlarged cross-sectional view of the example hollow point bullet of FIG. 1 taken along the 2—2 line of FIG. 1.

The square recess 11 has a larger length (i.e., deeper depth) than the round recess 13 (FIG. 1). With a nominal caliber bullet such as, for example, 4.6 millimeters, the length of the square recess 11 may be approximately 4.0 millimeters, and the length of the round recess 13 may be approximately 2.0 millimeters. Further, in the illustrated example, the maximum dimension across the second portion 13 is less than the maximum dimension across the first portion 11, i.e., the opening of the square recess 11 has a larger width than the diameter of the rounded recess 13 (FIG. 2). This difference results in a protrusion 17 of the bullet material between the two recesses 11 and 13 that may be as small as one-tenth of a millimeter to the side of the square recess 11. When the bullet 5 strikes a target, the tip 9 of the bullet 5 expands outward, but the protrusion 17 ensures that the bent out portions of the tip 9, or barbs, do not rip off after impact and deformation of the bullet 5.

Because the square recess 11 broaches the tip 9 of the bullet 5, an opening with curved edges and set-back corners is created. This opening ensures that upon impact the bullet 5 rips very quickly and evenly along the longitudinal edges of the square recess 11. The protrusion 17 between the square and round recesses 11, 13 stops these rips so that the bent-out barbs made of the tip 9 of the bullet 5 do not rip off.

In the illustrated example, the bullet 5 does not have a special-shaped, lead-filled jacket. Instead, the bullet 5 is made of a material such as, for example, a very tough, soft-metal alloy, on which a guide layer made of copper or the like can be plated or galvanized. The weight of the bullet 5 is only negligibly decreased by the two recesses 11, 13.

The illustrated example hollow point bullet 5 has ballistics corresponding to a full-jacket bullet but is capable of releasing much more of its kinetic energy when penetrating a live body than the corresponding conventional gun bullet can without the destructive effect being greater than, for example, a bullet from a police pistol. These characteristics are attributable to the design of the bullet 5 that incorporates a square recess 11 that opens at the tip 9 of the bullet 5 at one end and adjoins a cylindrical recess 13 at the opposite end.

Because the square recess 11 is opened at the tip 9 of the bullet 5 at one end and adjoined to the cylindrical recess 13 at the opposite end, the tip 9 is able to flare out upon impact of the bullet 5, creating barbs that do not disassociate from the remainder of the bullet 5. Conventional hollow point bullets disintegrate into barbs that break, either partially or fully, from the remainder of the bullet upon impact.

The tip 9 and resulting barbs remain attached to the remainder of the bullet 5 due to the protrusion 17. The protrusion provides for a gentle, soft transition during the deformation of the bullet 5 allowing the barbs to remain on the bullet 5. Upon impact, the cross-section of the bullet 5 can increase up to four times its size, yet the bullet 5 remains a unitary piece. There are several advantages to this design. For example, it would be very easy to remove the bullet 5 from a person in an operation because only one piece needs to be located and extracted. Also, if necessary, the bullet 5 can be dimensioned to have a large enough cross-section for special uses such as, for example, that the bullet 5 does not penetrate partition walls and the like.

In conventional hollow point bullets, the back part of the bullet facilitates penetration of the bullet into a target, which may increase damage to the target. In the illustrate example, the barbs formed from the tip 9 of the bullet 5 at impact quickly decelerate the bullet 5. The rapid deceleration decreases the destructive effect of the bullet 5.

In order to prevent the barbs from ripping too deeply, according to illustrated example, the square recess 11 continues into the circular recess 13. The preventative effect is further improved if the circular recess 13 has a slightly smaller diameter that the smallest width of the square recess 11. The protrusion 17 between the two recesses 11, 13 interrupts the ripping of the barbs of the tip 9 and the fact that the protrusion 17 is relatively small also decelerates the ripping slightly. The deformation of the tip 9 of the bullet 5 can also be controlled by the number of edges on the cross-section of the recess 7, the selection of the bullet material, and the caliber of the bullet 5.

As stated above, the recess 7 has a first portion 11 that is designed with a square-edged cross-section. Thus, each of the edges of the recess 11 is separated from the other by 90° along the inner perimeter. With fewer than four edges on the cross-section, the deformation of the tip 9 upon impact is more difficult; with more than four edges, deformation is easier.

Also, as stated above, it is particularly advantageous if the recesses 11, 13 have certain dimensions relative to one another. For example, it is particularly valuable if the circular recess 13 is shorter along the center axis 15, than the square recess 11. Specifically, it is particularly advantageous of the circular recess 13 is approximately half as long as the square recess 11. Stated differently, the circular recess 13 should be approximately half as deep as the square recess 11. These relative dimensions enhance the functioning of the bullet 5 upon impact without adversely or overly affecting the weight of the bullet 5.

An additional feature of the illustrated example that facilitates a smooth tearing of the tip 9 into barbs that do not disassociate from the bullet 5 is that the square recess 11 only extends along a tapered portion 6 of the bullet, which includes the tip 9, and the circular recess 13 extends towards the middle of the bullet 5 in a full-caliber portion 8. The tapered portion 6 is not as thick as the full-caliber portion 8 of the bullet 5, which is of full-caliber size. In the illustrated example, the transition from the tapered portion 6 to the full-caliber portion 8 occurs at the 2—2 line (FIG. 1). Once the tapered portion with the tip 9 is torn back along the full length of the square recess 11, the tearing portion, or barbs, reach the protrusion 17 and the full-caliber portion 8 of the bullet 5. The protrusion 17 and the thicker portion of the bullet 5 slow the tearing of the tip 9 and the bullet 5 itself. An optimal relevant dimension of the square recess 11 with respect to the entire length of the bullet 5 is that the square recess 11 is one-fifth to one-third, preferably one-fourth, of the overall length of the bullet 5.

Furthermore, the width of the opening of the square recess 11, i.e., the distance between two opposite-lying sides of the square recess 11 is approximately one-third of the caliber. A smaller recess would rip too late, and a larger one would create flak. In addition, though the hollow point bullet 5 disclosed herein can be used on all types of bullets, the effects of the hollow point bullet 5 are best observed when the bullet caliber is approximately 4.6 millimeters, which is much smaller in diameter than all known police bullets. However, the bullet 5 expands to a caliber of approximately 9 millimeters upon impact, without barbs or other splinters breaking off. Furthermore, an optimal trajectory is achieved with a relatively low muzzle energy. It is particularly advantageous, with small caliber bullets, that the distance between two opposite-lying sides of the square recess 11 is approximately 1.5 millimeters and that the diameter of the circular recess 13 is approximately 1.3 millimeters.

In conventional hollow point bullets, a recess or bore hole is filled or at least covered to ensure that the hollow point bullet does not create drag or otherwise adversely affect the trajectory. However, according to the illustrated example, it is preferred that the recesses 11, 13 are open and exposed. Not inserting a fill or adding a barrier cover prevents having an insert or barrier from dislodging from the bullet, which can lead to feed malfunctions or to a change in the trajectory or ballistics. Furthermore, without an insert or cover, there is no chance that such an insert or cover would dislodge upon impact and become a detached splinter or shrapnel.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. Hollow point bullet comprising a recess opened at a tip of the bullet that includes a first portion and a second portion, wherein at least one of the first portion or the second portion opens to the tip or the bullet, and wherein the first portion has a square cross-section transverse to a longitudinal axis of the bullet and the second portion has a circular cross-section transverse to a longitudinal axis of the bullet.

2. The hollow point bullet as defined in claim 1, wherein the second portion has a depth shorter than a depth of the first portion.

3. The hollow point bullet as defined in claim 2, wherein the depth of the second portion is approximately half as long as the depth of the first portion.

4. The hollow point bullet as defined in claim 3, wherein the bullet further comprises a tapered portion and a full-caliber portion and wherein the first portion extends the length of the tapered portion.

5. The hollow point bullet as defined in claim 1, wherein the second portion has a diameter smaller than a length of a side of the first portion.

6. The hollow point bullet as defined in claim 4, wherein the second portion has a depth shorter than a depth of the first portion.

7. The hollow point bullet as defined in claim 1, wherein the bullet further comprises a tapered portion and a full-caliber portion and wherein the first portion extends the length of the tapered portion.

8. The hollow point bullet as defined in claim 1, wherein the length of the first portion is one-fifth to one-third of the overall length of the bullet.

9. The hollow point bullet as defined in claim 1, wherein width of the first portion is approximately one-third of the caliber of the bullet.

10. The hollow point bullet as defined in claim 1, wherein the nominal caliber of the bullet is approximately 4.6 millimeters.

11. The hollow point bullet as defined in claim 10, wherein the width of the first portion is approximately 1.5 millimeters.

12. The hollow point bullet as defined in claim 11, wherein the diameter of the second portion is approximately 1.3 millimeters.

13. The hollow point bullet as defined in claim 1, wherein the first and second portions are open towards the tip of the bullet.

14. Hollow point bullet comprising a recess opened at a tip of the bullet that includes a first portion and a second portion, wherein the first portion has a differently shaped cross-section transverse to a longitudinal axis of the bullet than the second portion, wherein the maximum dimension across the second portion is less than the maximum dimension across the first portion, and wherein the difference in the maximum dimensions across the first and second portions stops further deformation of the bullet or ensures that portions of the tip do not rip off upon impact with a target.

15. The hollow point bullet of claim 14, wherein one of the first portion or second portion has a square shaped cross-section and the other of the first portion or second portion has a circular shaped cross-section.

16. The hollow point bullet as defined in claim 14, wherein the second portion has a depth shorter than a depth of the first portion.

17. The hollow point bullet as defined in claim 14, wherein the bullet further comprises a tapered portion and a full-caliber portion and wherein the first portion extends the length of the tapered portion.

18. A hollow point bullet as defined in claim 17, wherein the second portion extends into the full-caliber pardon of the bullet.

19. A method of fabricating a hollow point bullet, the method comprising forming a first and a second recess at a tip of the bullet where the first and second recesses are differently shaped and open at the tip of the bullet, and wherein the maximum dimension across the second recess is less than the maximum dimension across the first recess, which stops further deformation of the bullet or ensures that portions of the tin do not rip off upon impact with a target.

20. The method as defined in claim 19, wherein the first recess has a square cross-section transverse to a longitudinal axis of the bullet and the second recess has a circular cross-section transverse to a longitudinal axis of the bullet.

* * * * *